United States Patent [19]

Benavides

[11] Patent Number: 4,795,027

[45] Date of Patent: Jan. 3, 1989

[54] SAFETY BOOK MATCHES

[76] Inventor: Manuel G. Benavides, 410 Shawnee, Corpus Christi, Tex. 78405

[21] Appl. No.: 147,881

[22] Filed: Jan. 25, 1988

[51] Int. Cl.[4] ..... A24F 27/04; A24F 27/12

[52] U.S. Cl. ..... 206/106

[58] Field of Search ..... 206/96, 104, 105, 106, 206/102

[56] References Cited

U.S. PATENT DOCUMENTS 2,104,621 1/1938 McKinnon, Jr. ..... 206/106

3,763,995 10/1973 Kevas ..... 206/102

*Primary Examiner*—William Price

*Attorney, Agent, or Firm*—G. Turner Moller

[57] ABSTRACT

A match book includes a match deck, an inner cover and an outer cover secured together by a staple. In one embodiment, a striking strip is located on the inside surface of the top flap of the outer cover. In another embodiment, a striking strip is located on the outside surface of the top flap of the inner cover. In both embodiments, the location of the striking strip provides a safety feature because a lit match is not apt to ignite the remaining match heads in the match deck.

3 Claims, 1 Drawing Sheet

SAFETY BOOK MATCHES

This invention relates to book matches and more particularly to a safe technique for packaging matches to minimize the possibility of igniting the remaining matches in the book.

A standard match book includes a deck of cardboard matches attached to a base along a perforated line and a cardboard cover folded so as to provide an upturned lip, a back portion adjoining the upturned lip, a top flap adjoining the back portion and a front flap adjoining the top flap. The base of the match deck is placed between the lip and back portion and secured in position with a staple extending through the lip, base and back. The front flap portion is openable and closeable by tucking the free end between the lip and the match deck base. Ten or fifteen years ago, a striking strip was provided on the lip, immediately below the staple. More recently, the striking strip was moved onto the back of the book in a location immediately under the staple. It was thought this arrangement would be safer because the user would turn the match book over while striking and thereby shield the remaining matches in the book from the flame of the ignited match. As will be more fully apparent hereinafter, the match book of this invention provides an even safer arrangement.

Of some interest regarding the match book of this invention are the disclosures in U.S. Pat. Nos. 1,125,647; 1,586,919; 1,926,682; 2,080,355; 2,104,621; 2,935,185; 3,871,517; 3,939,970; 4,029,203; 4,053,048; 4,095,689.

From one point of view, this invention comprises a match book having an extra cover overlying a first more-or-less conventional cover with a striking abrasive strip being located on the top flap of the facing, overlying covers. In one embodiment of this invention, the striking strip is on the inside surface of the top flap of the outer cover. In another embodiment of this invention, the striking strip is on the outside surface of the top flap of the inner cover.

One object of this invention is to provide an improved match book having improved safety features.

Other objects and advantages of this invention will become more fully apparent as this description proceeds, reference being made to the accompanying drawing and appended claims.

IN THE DRAWINGS

Figure 1:
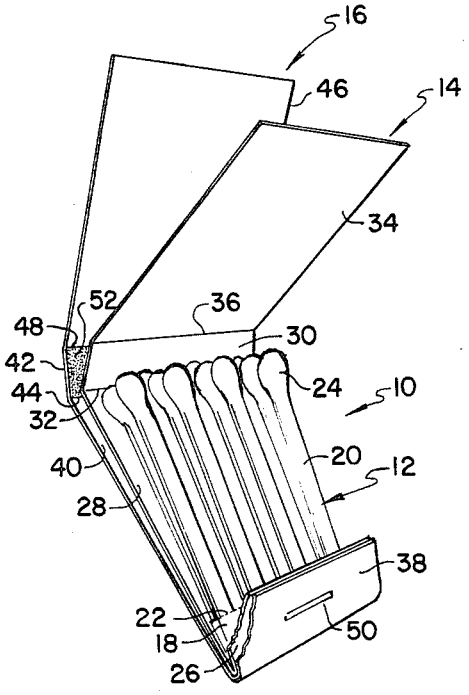
FIG. 1 is an isometric view of a match book of this invention, illustrating the match book in an open position as when a match is in the process of being torn from the match deck.
Figure 2:
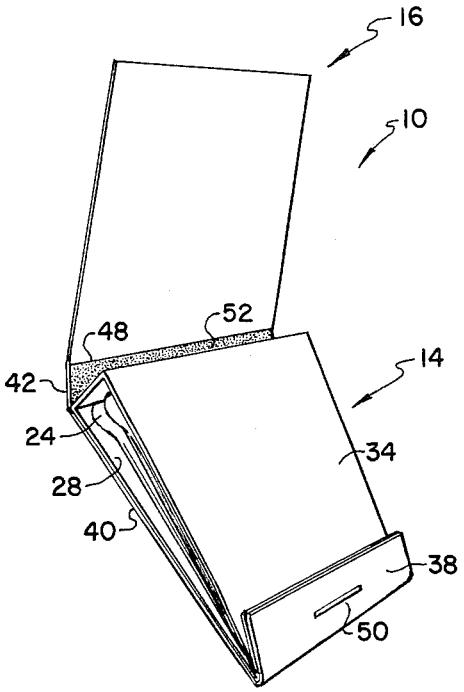
FIG. 2 is an isometric view of the match book of FIG. 1, illustrating the match book in a partially closed position as when a match is in the process of being ignited by being drawn across the striking strip.

Referring to FIGS. 1–2, there is illustrated a match book 10 of this invention comprising, as major components, a match deck 12, an inner cover 14 and an outer cover 16.

The match deck 12 is of conventional design, is of paper or cardboard and includes a base 18 having a multiplicity of parallel, equal length cardboard matches

20 extending away from a perforated line 22. The matches 20 each terminate in an ignitable head 24.

The inner cover 14 comprises a section of paper or cardboard and includes an upturned lip 26, a back portion 28, a top flap 30 separated from the back portion 28 by a fold line 32 and a front flap 34 separated from the top flap 30 by a fold line 36. As will be more fully apparent hereinafter, the bottom of the front flap 32 is received under the upturned lip 26 when the match book 10 is in its closed position. The inner cover 14 includes an inside surface facing the match deck 12 in the closed position of the cover and an outside surface facing the outer cover 16.

The outer cover 16 comprises a section of paper or cardboard and includes an upturned lip 38, a back portion 40, a top flap 42 separated from the back portion 40 by a fold line 44 and a front flap 46 separated from the top flap 42 by a fold line 48. As will be more fully apparent hereinafter, the bottom of the front flap 46 is received under the upturned lips 26, 38 when the match book 10 is in its closed position. The outer cover 16 includes an inside surface facing the match deck 12 and inner cover 14 in the closed position of the cover and an outside surface.

A staple 50 passes through the upturned lips 26, 38 and the bottom of the back portions 28, 40 to connect the various portions of the match book 10 together.

A striking strip 52, usually of an abrasive material, is affixed to the inside surface of the top flap 42 of the outer cover 16. When the match heads 24 are drawn against the striking strip 52, the match heads 24 are ignited in a conventional manner. Placing the striking strip 52 on the top flap 42 has a number of exceptional advantages. First, there is an important safety feature. The user has to fold the inner cover 14 over the match deck 12 to gain access to the striking strip 52. This covers the match heads 24 remaining on the match deck 12 and prevents the lit match from igniting the balance of the match deck. Second, there is advertising space on the inside surface of the outer cover 16, the outside surface of the inner cover 14 and the inside surface of the inner cover 14. Third, the striking surface 52 will not get wet if the match book 10 is laid on its back. It will accordingly be seen that this positioning of the striking strip 52 provides a number of advantages not apparent in the prior art.

Figure 3:
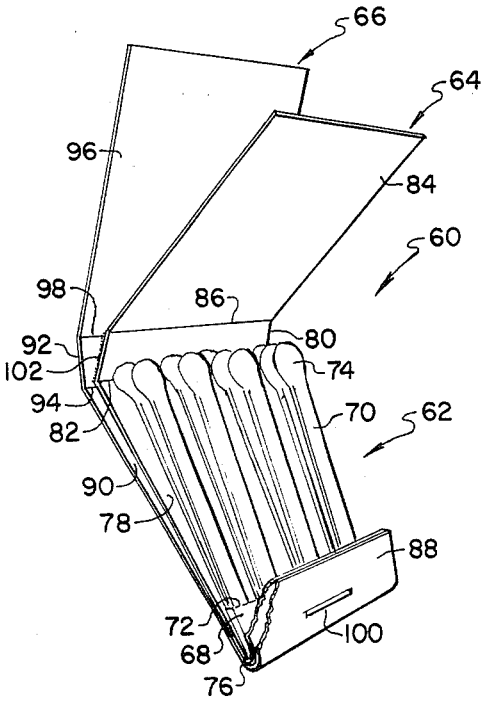
FIG. 3 is a view similar to FIG. 1, illustrating another match book of this invention.
Figure 4:
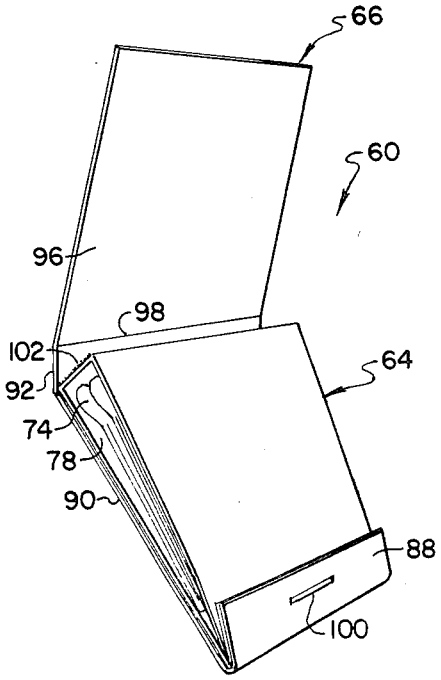
FIG. 4 is a view similar to FIG. 2, illustrating the embodiment of FIG. 3.

Referring to FIGS. 3–4, there is illustrated another embodiment of a match book 60 of this invention comprising, as major components, a match deck 62, an inner cover 64 and an outer cover 66.

The match deck 62 is of conventional design, is of paper or cardboard and includes a base 68 having a multiplicity of parallel, equal length cardboard matches 70 extending away from a perforated line 72. The matches 70 each terminate in an ignitable head 74.

The inner cover 64 comprises a section of paper or cardboard and includes an upturned lip 76, a back portion 78, a top flap 80 separated from the back portion 78 by a fold line 82 and a front flap 84 separated from the top flap 80 by a fold line 86. As will be more fully apparent hereinafter, the bottom of the front flap 82 is received under the upturned lip 76 when the match book 60 is in its closed position. The inner cover 64 includes an inside surface facing the match deck 62 in the closed position of the cover and an outside surface facing the outer cover 66.

The outer cover 66 comprises a section of paper or cardboard and includes an upturned lip 88, a back portion 90, a top flap 92 separated from the back portion 80 by a fold line 94 and a front flap 96 separated from the top flap 92 by a fold line 98. As will be more fully apparent hereinafter, the bottom of the front flap 96 is received under the upturned lips 76, 88 when the match book 60 is in its closed position. The outer cover 66 includes an inside surface facing the match deck 62 and inner cover 64 in the closed position of the cover and an outside surface.

A staple 100 passes through the upturned lips 76, 88 and the bottom of the back portions 78, 90 to connect the various portions of the match book 60 together.

A striking strip 102, usually of an abrasive material, is affixed to the outside surface of the top flap 80 of the inner cover 64. When the match heads 24 are drawn against the striking strip 102, the match heads 74 ignite in a conventional manner. Placing the striking strip 102 on the top flap 64 has a number of exceptional advantages. First, there is an important safety feature. The user has to fold the inner cover 64 over the match deck 62 to gain access to the striking strip 102. This covers the match heads 74 remaining on the match deck 62 and prevents the lit match from igniting the balance of the match deck. Second, there is advertising space on the inside surface of the outer cover 66, the outside surface of the inner cover 64 and the inside surface of the inner cover 64. Third, the striking surface 102 will not get wet if the match book 60 is laid on its back. It will accordingly be seen that this positioning of the striking strip 102 provides a number of advantages not apparent in the prior art. It will accordingly be seen that the match books 10, 60 are identical except for the placement of the striking strips 52, 102.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A match book comprising a deck of cardboard matches including a base having a perforate line thereon and a multiplicity of parallel equal length matches extending away from the perforate line;

an inner cover having an inside surface and an outside surface, an inner upturned lip receiving the match deck base, a inner back portion adjoining the inner upturned lip, an inner top flap adjoining the inner back portion and an inner front flap adjoining the inner top flap;

an outer cover of substantially the same size as the inner cover and superposed relative thereto, the second cover having an inside surface and an outside surface, an outer upturned lip receiving the inner upturned lip, an outer back portion adjoining the inner upturned lip, an outer top flap adjoining the outer back portion and an outer front flap adjoining the outer top flap, the inside surface of the outer cover facing the outer surface of the inner cover;

a staple extending through the inner and outer upturned lips, the match deck base and the inner and outer back portions and securing the match deck, inner and outer covers together into a match book, the front flaps of the inner and outer covers being removably received between the upturned lips and the match deck base; and a striking abrasive strip located between the inside surface of the outer top flap and the outside surface of the inner top flap.

2. The match book of claim 1 wherein the striking abrasive strip is secured to the inside surface of the outer top flap and faces the outside surface of the inner top flap.

3. The match book of claim 1 wherein the striking abrasive strip is secured to the outside surface of the inner top flap and faces the inside surface of the outer top flap.

* * * * *